United States Patent [19]

Kotwica

[11] Patent Number: 4,469,169

[45] Date of Patent: Sep. 4, 1984

[54] DISTRIBUTION DEVICE FOR MULTITUBULAR EXCHANGERS

[75] Inventor: Roland Kotwica, Pont Ste Maxence, France

[73] Assignee: Societe Chimique des Charbonnages-CDF Chimie, Paris, France

[21] Appl. No.: 388,698

[22] Filed: Jun. 15, 1982

[30] Foreign Application Priority Data

Jun. 15, 1981 [FR] France ..... 81 11696

[51] Int. Cl.[3] ..... F28F 9/02

[52] U.S. Cl. ..... 165/174

[58] Field of Search ..... 165/174, 115, 118

[56] References Cited

U.S. PATENT DOCUMENTS

| | | | |
|---|---|---|---|
| 1,124,740 | 1/1915 | Holt | 165/174 |
| 1,743,989 | 1/1930 | Wainwright | 165/174 |
| 4,153,043 | 5/1979 | Goolsby | 165/115 X |
| 4,173,615 | 11/1979 | Otsuka et al. | 165/174 X |
| 4,199,537 | 4/1980 | Zardi et al. | 165/174 X |
| 4,202,182 | 5/1980 | Kawashima et al. | 165/174 X |

FOREIGN PATENT DOCUMENTS

| | | | |
|---|---|---|---|
| 1461925 | 1/1977 | United Kingdom | 165/174 |

*Primary Examiner*—Sheldon J. Richter

*Attorney, Agent, or Firm*—Finnegan, Henderson, Farabow, Garrett & Dunner

[57] ABSTRACT

A distribution cap for a multitubular falling heat exchanger, in which the exchanger has a bundle of parallel tubes, an entrance channel for the tubes and a perpendicularly disposed distribution plate surrounding the entrance end of the tubes, the distribution cap is located in the entrance channel above the distribution plate and over the entrance ends of the tubes, and has cylindrical sidewalls and a closed top having sides that slope downwardly toward the cylindrical sidewalls of the cap.

9 Claims, 4 Drawing Figures

DISTRIBUTION DEVICE FOR MULTITUBULAR EXCHANGERS

BACKGROUND OF THE INVENTION

The present invention relates to a liquid distribution device for a multitubular falling film heat exchanger and to an exchanger fitted with such a device.

A multitubular heat exchanger generally consists of a bundle of parallel tubes within an outer shell. Two liquid flow systems have to be considered; the first is outside of the tubes and the second is inside the tubes. An entry channel usually receives the fluid being distributed to the insides of the tubes and an exit channel receives and discharges the fluid that has passed through the tubes. Separation between the two fluid systems is ensured by providing two spaced apart, tube plates, that extend across the shell and into which the ends of the tubes of the bundle are welded.

It has been found, that if the fluid flowing into the inside of the tubes is a mixture of a non-dispersed liquid phase and a gas phase, for instance a liquid phase in the presence of its saturated vapor, one frequently encounters an inequality of distribution of the liquid phase between the tubes of the bundle.

Various means have been developed in the past for improving the distribution of a homogeneous liquid phase between the tubes of a multitibular exchanger. One such means is described in "Die Bemessung der Zu-und Abflusshauben von Warmeaustauschern" (Dimensioning of the entry and exit bonnets of heat exchangers), Kaltetchnik, 15th year, volume 3 (1963), page 85. This article describes the use of concentric partitions arranged in the entry channel of the exchanger or of a disc with holes in it arranged in the entry channel perpendicular to the axis of the exchanger. It should be noted that such a disc does not occupy the whole available cross section of the entry channel.

Further French Pat. No. 2,268,178 describes the placing of a perforated filleted cap in the entry channel of an exchanger. This filleted cap is open at its top and is situated at the entry of the entry channel of the exchanger.

These prior art devices, however, are not satisfactory if there is a liquid phase and a gaseous phase. In this case the liquid, which enters in the upper part of the entry channel of the exchanger, always moves preferentially toward the central tubes of the bundle of tubes, although to a lesser extent when compared with exchangers not fitted with these devices at all.

SUMMARY OF THE INVENTION

An object of the present invention therefore is to provide a device that ensures a uniform distribution of a liquid flowing by gravity into each tube of a vertical multitubular heat exchanger.

Additional objects and advantages of the invention will be set forth in part in the description which follows and in part will be obvious from the description or may be learned by practice of the invention. The objects and advantages of the invention may be realized and obtained by means of the instrumentalities and combinations particularly pointed out in the appended claims.

To achieve the foregoing objects and in accordance with the purpose of the invention, there is provided a distribution cap for a multitubular falling heat exchanger in which the exchanger has a bundle of parallel tubes, an entrance channel for the tubes and a perpendicularly disposed distribution plate surrounding the entrance end of the tubes. The distribution cap is located in the entrance channel above the distribution plate and over the entrance ends of the tubes, and has cylindrical sidewalls and a closed top having sides that slope downwardly toward the cylindrical sidewalls of the cap.

DESCRIPTION OF THE PREFERRED EMBODIMENTS

Further features of the invention and its advantages can be found in the following description and in the drawings.

Figure 1:
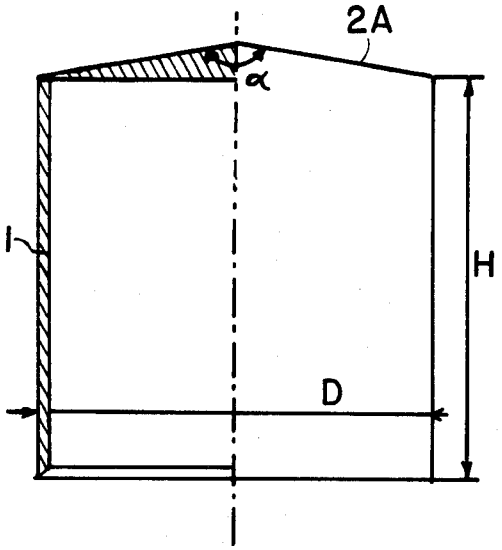
FIG. 1 is an elevational view, partly in section, of a distribution cap of the present invention.
Figure 2:
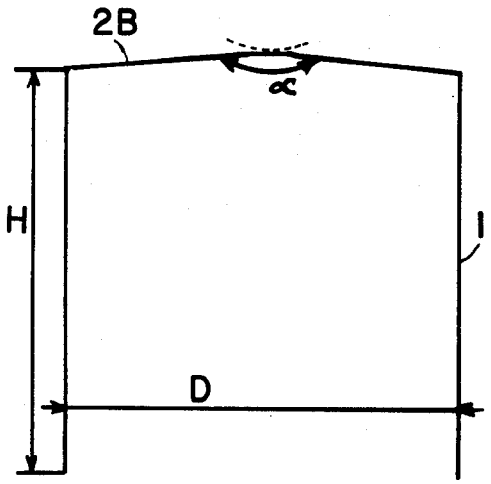
FIG. 2 is an elevational view of an alternative cap.

FIGS. 1 and 2 both show a distribution device for a multitubular heat exchanger constructed in accordance with the present invention. The device is essentially a cap 1 having cylindrical sidewalls 1 and open bottom and a closed top 2. The cap has a height H and an external diameter D for the cylindrical part of the cap. In FIG. 1 the top 2A of the cap is conical and in FIG. 2 the top 2B is a truncated cone. In other words, the sloping surfaces of the top 2B terminate in a flat in the top center of the cap as shown in FIG. 2. $\alpha$ is the angle of the sloping surfaces of the conical or truncated conical top of the cap.

Figure 3:
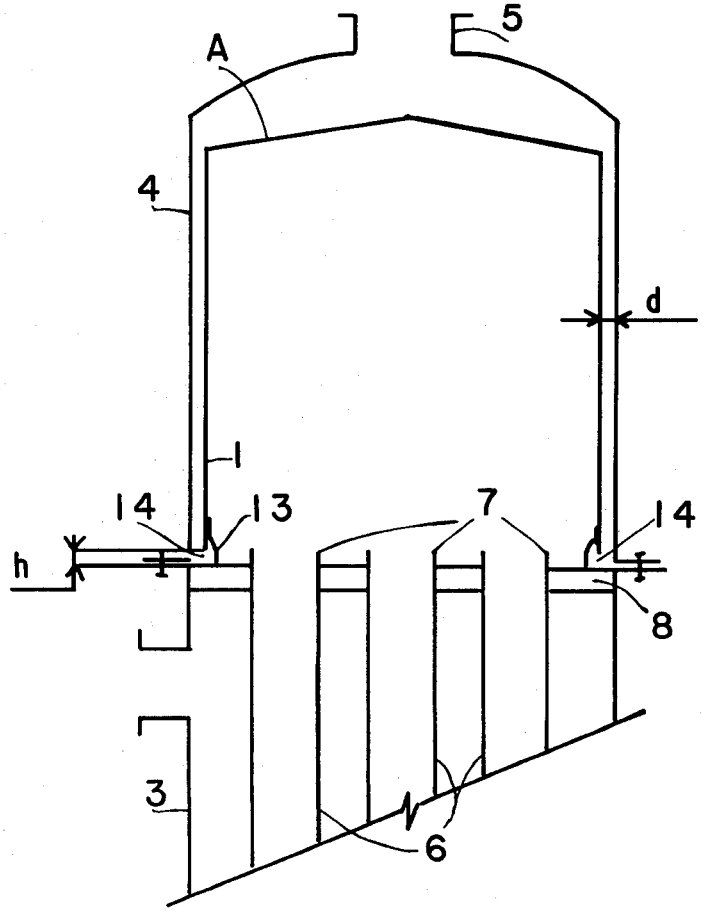
FIG. 3 is an elevational view of a multitubular heat exchanger fitted with the distribution cap of FIG. 1.

FIG. 3 shows a multitubular heat exchanger fitted with the distribution device described above. The heat exchanger has an outer shell 3, a bundle of parallel tubes 6 within the shell, an entry channel 4, an entry header 5 for the channel and a tube distribution plate 8 disposed perpendicular to the axis of the shell and the tubes and into which are welded the upper ends 7 of the tubes 6, forming the bundle. The distribution device or cap 1 is located in entry channel 4 of the exchanger by means of brackets 13 in such a manner that all the open ends 7 of tubes 6 are situated inside of the cap, and that one or several orifices 14 are formed or left between the bottom of the cylindrical part of cap 1 and tube plate 8.

Thus it can be seen that the distribution cap is placed in the entry channel of the multitubular exchanger in such a way that the liquid entering the entry channel 4 trickles down over the outside of the conical top of the cap 1, then over the outside of the cylindrical part and then through the orifice or orifices 14 formed between the bottom of the cylindrical part of the cap and tube plate 8 of the exchanger before being distributed in the tubes 6.

The preferred height h of the orifice or orifices is between 5 and 15 mm. The external diameter D of the cylindrical part of cap 1 is chosen such as to form between the inner surface of the entry channel 4 and the outer surface of the cylindrical part of the cap when used with a multitubular heat exchanger 1 a space d, as shown in FIG. 3, of between 1 and 5 mm.

Preferably the total height H of distribution cap 1 is at most equal to the height of entry channel 4 of the heat exchanger. In order to obtain greatest efficiency, this height is preferably between 0.8 and 0.95 times the height of channel 4. The preferred angle $\alpha$ at the top of the conical part is between 140° and 160° and the preferred external diameter D of the cylindrical part is between 0.8 and 1.2 times the height H of said cylindrical part.

It has been found that by using a distribution cap according to the invention, it is possible to obtain a more uniform distribution of the liquid between the bundle of tubes of a multitubular heat exchanger than has been possible with the prior art devices.

Figure 4:
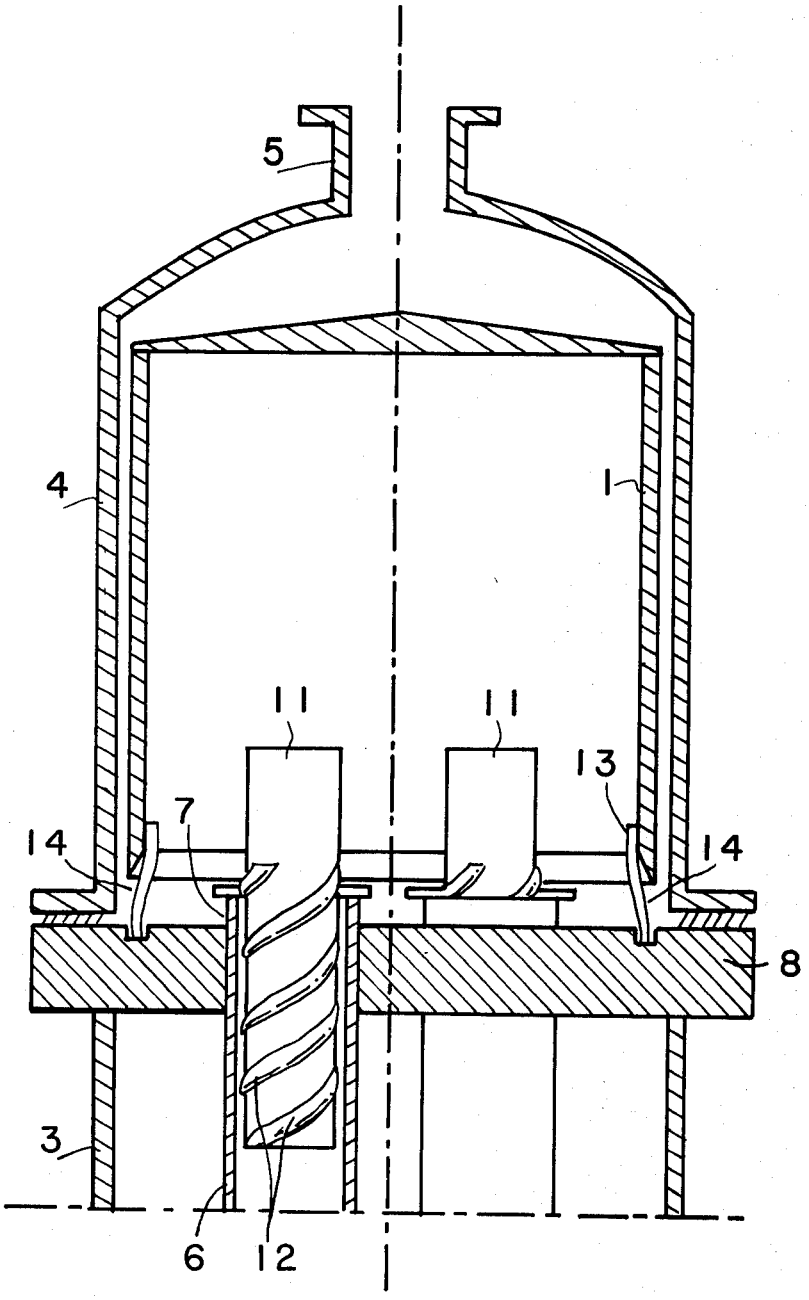
FIG. 4 is a view similar to FIG. 3 including a spreading device for each of the tubes of the heat exchanger.

According to a preferred embodiment of the invention, and in an effort to further improve the distribution of the liquid on the interior surface of each tube of the heat exchanger, an individual spreading means for each exchanger tube is provided in combination with the distribution cap. As shown in FIG. 4, this spreading means preferably consists of a cylindrical drum 11 provided with helical fins 12 that is partially inserted into each tube 6 in such a way as to leave a space for the passage of the liquid into and through the tube. As shown, the outer diameter of the fins 12 of spreading drum 11 is slightly less than the inside diameter of the tube 6 which receives the spreading device.

The presence of such a spreading means at the entrance of each tube does not interfere with the uniform distribution of liquid between the different tubes ensured by the distribution cap 1.

The distribution device according to the invention, and whether or not the spreading means of FIG. 4 is associated with it, finds a particularly valuable application in plants for the concentration and dehydration of maleic acid which utilizes the static cocurrent evaporation process according to U.S. Pat. No. 4,414,398 to Kotwica et al.

It will be apparent to those skilled in the art that various modifications can be made without departing from the scope or spirit of the invention and without sacrificing its chief advantages.

What is claimed is:

1. A falling film multitubular heat exchanger comprising:

(a) an outer shell;

(b) a nonforaminous axially disposed entry header for admitting a fluid to the interior of said heat exchanger;

(c) at least two vertically oriented tubes contained within said outer shell;

(d) an entry channel in said outer shell in flow communication with said entry header and the interior of said tubes;

(e) a distribution plate disposed perpendicularly to and surrounding the entrance ends of said tubes, thereby isolating said entry channel from the exterior of said tubes, wherein said entrance ends of said tubes are located at a first height above said distribution plate; and (f) a distribution cap located in said entry channel above said distribution plate, said cap consisting of cylindrical sidewalls and a closed top having sides that slope downwardly toward the cylindrical sidewalls, and being positioned so that said entrance ends of each of said tubes are situated inside the circumference of said sidewalls of said cap and wherein the bottom of said sidewalls is located at a second height, higher than said first height, above said distribution plates, wherein the diameter of said entry header is smaller than the diameter of said cap, and wherein at least one orifice is formed between the bottom of said sidewalls and said distribution plate whereby a liquid introduced into the entry header and the channel strikes the closed top, trickles down over the outside of the closed top of the cap and then down the sidewalls between the sidewalls and the outer shell and onto the distribution plate before passing into the tubes to achieve a more uniform distribution of the liquids in the tubes.

2. The distribution cap of claim 1 wherein the sloping sides of the top form an angle between them of from 140° to 160°.

3. The distribution cap of claim 2 wherein the sloping sides of the top come together to form a conical top to the cap.

4. The distribution cap of claim 2 wherein the sloping sides of the top terminate in a flat at the top of the cap to form a trunicated conical top to the cap.

5. The distribution cap of claim 1 wherein the external diameter of the cylindrical sidewalls of the cap is from 0.8 to 1.2 times the height of the cylindrical sidewalls of the cap.

6. The exchanger of claim 1 wherein the height of the orifice formed between the bottom of the cap and the plate is between 5 and 15 mm.

7. The exchanger of claim 6 wherein the external diameter of the cylindrical sidewalls of the cap is between 1 and 5 mm less than the internal surface of the entry channel.

8. The exchanger of claim 7 wherein the height of the cap is between 0.80 and 0.95 times the height of the entry channel.

9. The exchanger of claim 1 including a cylindrical drum provided with helical fins in the entrance end of each tube to spread the liquid in an even film around the insides of the tubes.

* * * * *